US005634482A

United States Patent [19]

Martin

[11] Patent Number: 5,634,482

[45] Date of Patent: Jun. 3, 1997

[54] POLE STAND

[75] Inventor: Leo Martin, Coconut Grove, Fla.

[73] Assignee: Miami Metal Products, Inc., Miami, Fla.

[21] Appl. No.: 428,018

[22] Filed: Apr. 25, 1995

[51] Int. Cl.[6] ..... A45B 3/00; F16M 13/00

[52] U.S. Cl. ..... 135/16; 135/99; 135/114; 248/521

[58] Field of Search ..... 248/519, 521, 248/522, 523; 135/16, 99, 114

[56] References Cited

U.S. PATENT DOCUMENTS

| | | | |
|---|---|---|---|
| 395,766 | 1/1889 | Westphal | 248/521 |
| 2,681,780 | 6/1954 | Santoro | 248/521 X |
| 3,051,423 | 8/1962 | Wagner et al. | 248/521 X |
| 3,648,957 | 3/1972 | Beneriscutto | 248/521 X |
| 3,794,279 | 2/1974 | Kramer | 248/523 |

FOREIGN PATENT DOCUMENTS

| | | | |
|---|---|---|---|
| 2712274 | 7/1978 | Germany | 248/519 |

*Primary Examiner*—Christopher Todd Kent

[57] ABSTRACT

A pole stand is provided which has a base and a cylinder extending therefrom to receive a pole. The base and cylinder are an integral unit with the diameter of the cylinder being larger than the diameter of the pole into which it is placed. At the base of the cylinder is a cup bearing on which the base of the pole rests. The pole has a collar secured to it which, when the pole is positioned within the cylinder, is below the upper lip of the cylinder. This collar fits snugly around the pole such that the pole is prevented from contacting the inside wall of the cylinder. Above the collar, yet still below the lip of the cylinder is a set screw through the cylinder to retain the collar, and thus the pole, within the cylinder.

2 Claims, 1 Drawing Sheet

POLE STAND

FIELD OF THE INVENTION

The present invention relates to a pole stand. More particularly, the present invention provides for a pole stand that counters the effects of wind on an object attached to the pole.

BACKGROUND OF THE INVENTION

There are a myriad of pole stands in existence. Stands that are used outside, however, require attention be paid to wind conditions and the items or objects affixed to the pole. For example, umbrellas affixed atop poles on stands are affected tremendously by wind conditions. If the umbrella is secured within a stand and unable to accommodate the wind, then the umbrella will be subject to torsional strains caused by the wind. Ultimately, due to the construction of the ribs or extensions of the umbrella, the umbrella or sections of it will fail and break. Further, if the umbrella is allowed to sit within a stand and not be secured thereby, the wind subjected to the umbrella may cause it to lift and fly out of the stand thus possibly injuring nearby individuals. Certainly the umbrella will sustain damage. It is clear from its face that this example as applied to an umbrella is equally applicable to any object atop a pole that is subject to the torsional strain of windy conditions.

SUMMARY OF THE INVENTION

The present invention overcomes the aforesaid problems by providing a pole stand that negates the torsional strain of windy conditions yet maintains a pole securely within the stand. A pole stand is provided which comprises a base and a cylinder extending therefrom to receive the pole. The base and cylinder are an integral unit with the diameter of the cylinder being larger that than the diameter of the pole into which it is placed. At the base of the cylinder is a cup bearing on which the base of the pole rests. The pole has a collar secured to it which, when the pole is positioned within the cylinder, is below the upper lip of the cylinder. This collar fits snugly around the pole such that the pole is prevented from contacting the inside wall of the cylinder. Above the collar, yet still below the lip of the cylinder is a set screw through the cylinder to retain the collar, and thus the pole, within the cylinder.

BRIEF DESCRIPTION OF THE DRAWINGS

The features embodying the present invention are illustrated in the accompanying drawings, forming a part of this application, in which.

DETAILED DESCRIPTION OF A PREFERRED EMBODIMENT

Figure 1:
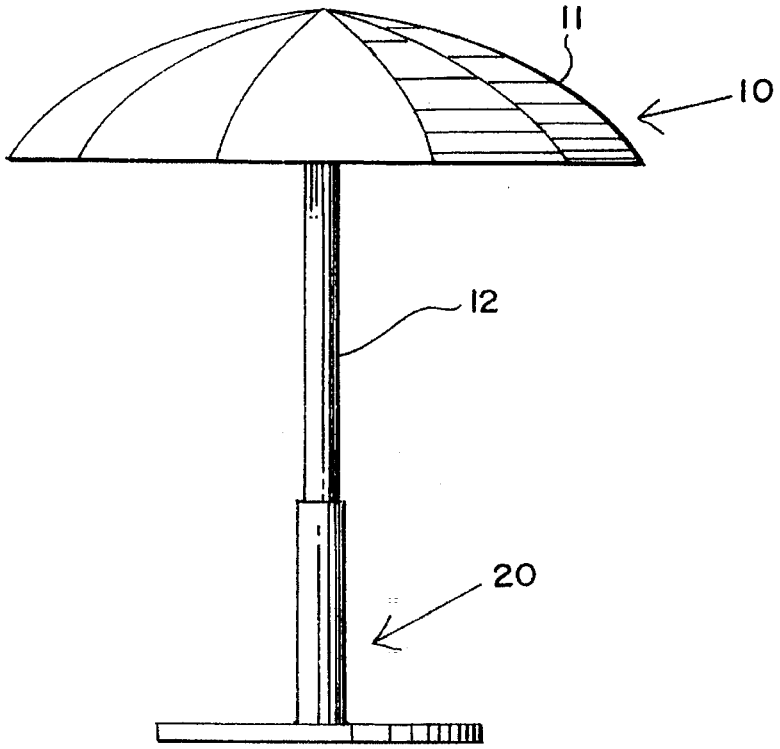
FIG. 1 is a cross section view of the present invention when used as an umbrella stand.

Referring now to the drawings, FIG. 1 depicts the present invention when used in conjunction with an umbrella. Umbrella 10 is generally comprised of a tarp 11 and a pole 12. The pole is retained within a stand 20.

Figure 2:
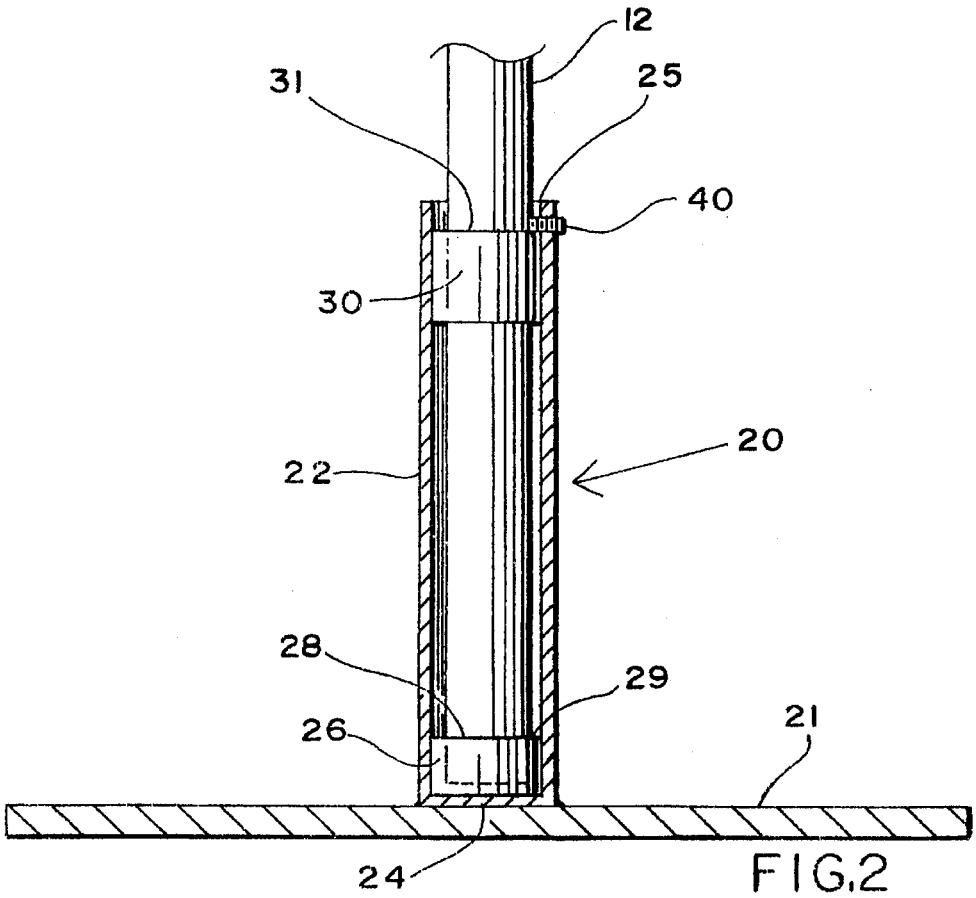
FIG. 2 is an enlarged cross section view of the present invention of FIG. 1 without depicting the umbrella.

Referring now to FIG. 2, stand 20 is comprised of a base plate 21 and cylinder 22 protruding therefrom. The base plate 21, of any stabile dimension, for example, square or rectangular, and cylinder 22 are integral, preferably being welded together. However, any convention may be employed to secure the base 21 to cylinder 22. Further, it is preferred to have a heavily weighted stand 20. Therefore, it is preferred to manufacture the stand 20 of a metal, for example, aluminum. Aluminum is a good choice of material as it is heavy and further does not rust. For purposes of stability, the cylinder 22 should be concentric with respect to the base 21.

Cylinder 22 has a diameter which is larger than pole 12. Cylinder 22 has a bottom section 24 and a top section 25. The bottom 24 of cylinder 22 houses a cup-shaped bearing 26. The bearing 26 should be manufactured of a material that has a low coefficient of friction. A synthetic plastic known by the tradename of DELRIN has been found to be an acceptable material with which to manufacture the bearing 26. The diameter of the pole 12 should not be greater than the diameter of cup bearing 26. Preferably, the diameter of pole 12 is the same diameter of bearing 26 so that the pole base 28 sits on top of the rim 29 of bearing 26.

A collar 30 is securely affixed to the outside of pole 12 below the top 25 of cylinder 22. The collar 30 should also be manufactured of a material that has a low coefficient of friction. A synthetic plastic known by the tradename of DELRIN has been found to be an acceptable material with which to manufacture the collar 30. The collar 30 may be pressure fit about the pole 12 or may be secured thereon by a countersunk screw (now shown) so that it cannot contact with the inside wall of cylinder 22. The outside diameter of collar 30 should not be so large as to impede the pole 12 from easily rotating within the cylinder 22. As disclosed, the bearing 26 and collar 30 have the same outside diameter.

When collar 30 is placed about the pole 12, and the pole 12 is set within the cylinder 22, the top 31 of collar 30 does not protrude from the cylinder top 25. A set screw 40 is secured through the cylinder 22 through a threaded hole (not shown). The set screw 40 is positioned above the top 31 of collar 30 and below the top 25 of cylinder 22, and protrudes a length over the collar 30 yet not so as to contact pole 12.

When the present invention is employed, for example, as an umbrella pole stand, the torsional strain caused by wind on the umbrella 10 is diminished because the pole 12 can rotate within cylinder 22 on top of cup bearing 26. The rotation is assisted by collar 30. However, pole 12 cannot lift from the stand 20 even if the umbrella 10 rotation becomes so great as to give it lift due to the physical impedance from the set screw 40 over the collar 30.

It is intended that the description of the preferred embodiments of this invention is illustrative only. Other embodiments of the invention that are within the scope and concept of this invention are herein included within this application.

What is claimed is:

1. A pole stand assembly, comprising, in combination;

a pole having an object situated thereon;

a stand comprising a base plate and a cylinder located thereon, said cylinder having a bottom and a top;

a bearing resting on the bottom of said cylinder such that said pole can sit atop said bearing when placed within said cylinder;

a collar fitted about said pole, and;

means for securing said pole to said stand comprising a set screw located above said collar and through said cylinder after said pole is placed within said cylinder.

2. An umbrella pole stand assembly, comprising, in combination;

a pole having an umbrella situated thereon;

a stand comprising a base plate and a cylinder located thereon, said cylinder having a bottom and a top;

a bearing resting on the bottom of said cylinder such that said pole can sit atop said bearing when placed within said cylinder;

a collar fitted about said pole, and;

means for securing said pole to said stand comprising a set screw located above said collar and through said cylinder after said pole is placed within said cylinder.

* * * * *